US005586764A

United States Patent [19]

Katz

[11] Patent Number: 5,586,764

[45] Date of Patent: Dec. 24, 1996

[54] CARD GAME SET HAVING BLOCK SHAPED TILES

[76] Inventor: Daniel B. Katz, 9979 Nob Hill La., Sunrise, Fla. 33351

[21] Appl. No.: 409,848

[22] Filed: Mar. 27, 1995

[51] Int. Cl.[6] ..... A63F 1/10; A63F 1/00

[52] U.S. Cl. ..... 273/293; 273/295; 273/150

[58] Field of Search ..... 273/293, 295, 273/150

[56] References Cited

U.S. PATENT DOCUMENTS

| | | | |
|---|---|---|---|
| 295,023 | 3/1884 | Law | 273/293 |
| 337,755 | 3/1886 | Endicott | 273/293 |
| 1,504,634 | 8/1924 | Luce | 273/150 |
| 1,682,485 | 8/1928 | Clark | 273/150 |
| 1,684,372 | 9/1928 | Maennlein | 273/295 |
| 1,890,504 | 12/1932 | Ferguson, Jr. | 273/295 |
| 2,600,951 | 6/1952 | Edwards | 273/295 |
| 3,828,447 | 8/1974 | Larkin | 434/348 |
| 4,147,363 | 4/1979 | Lee et al. | 273/304 |
| 4,333,656 | 6/1982 | Sommer | 273/299 |
| 5,226,665 | 7/1993 | Huang | 273/295 |

FOREIGN PATENT DOCUMENTS

| | | | |
|---|---|---|---|
| 398674 | 9/1933 | United Kingdom | 273/293 |

*Primary Examiner*—Benjamin H. Layno
*Attorney, Agent, or Firm*—Malin, Haley, DiMaggio & Crosby, P.A.

[57] ABSTRACT

A novel card game set including a plurality of card game block-style tiles. Each tile bears traditional Western-style card indicia. Each tile is made of a plurality of individually laminated wood layers permanently prressed together to form a high gade plywood piece. Each tile is completely covered with a protective waterproof enamel coating. The waterproof enamel coating has a granular substance to give each tile a semi-rough exterior surface to facilitate gripping. The tiles are of sufficient thickness for convenient handling by young, unskilled and arthritic persons. Each tile is of sufficient weight to resist the force of wind and sudden drafts for facilitating the playing of games outdoors. The card game set also including a rack for supporting the tiles in strategic alignment.

7 Claims, 3 Drawing Sheets

CARD GAME SET HAVING BLOCK SHAPED TILES

BACKGROUND OF THE INVENTION

1. Field of The Invention

The present invention relates generally to a novel card game set for playing traditional or contemporary card games, and more particularly, to a plurality of rigid tiles having conventional card game faces and sufficient weight and durability for playing card games indoors and outdoors, and support racks for holding and organizing select tile pieces.

2. Description of the Background Art

Traditional playing cards have always enjoyed widespread use, however, they have never been conducive to outdoor use. The playing cards employed to date typically are made from paper products, such as cardboard, which include a slick waxy surface. These traditional type playing cards are known for being light and difficult to handle for the unskilled player, the elderly or arthritic person. Paper-styled playing cards have limited durational use, frail around the edges, tear, cannot be cleaned or exposed to moisture, and are easily blown around by wind and drafts. Conventional playing cards also lose their rigidity through repeated use and shuffling. Moreover, arthritic, disabled and elderly persons find it difficult to handle traditional playing cards because their hands have difficulty performing the finer motor skills required to manipulate thinly constructed cards. Playing cards, however, having increased weight, more durable construction and greater thickness would be easier to handle as well as more practical for outdoor use, more tolerant of rugged handling and more resilient for extended use over time. Consequently, a novel tile type card playing set would be well received if it overcame the foregoing shortcomings.

Several games are noted in the background art, which offer alternatives to traditional playing cards, but none of which address the problems noted by the present invention, or which offer a novel game tile set. For instance, Law, U.S. Pat. No. 295,023, teaches a domino made of wood, which may also have a playing card face pressed into it. The domino device taught by Law offers a construction which primarily attempts to protect the surface of the domino wood pieces by providing raised edges around the face, a pivotal pin projecting from the middle of the face and a celluloid cement covering. In contrast with the present invention, Law discloses a complex domino that does not provide flat continuous surfaces resulting in semi-smooth block-like structures.

Other references include the following listed hereto. Maennlein in U.S. Pat. No. 1,684,372, discloses a metallic playing card, typically of an aluminum alloy material. In U.S. Pat No. 1,890,504, Ferguson teaches a playing card made of paper, fabric, and/or any combination thereof which includes weighted material, such as tin, lead or silver foil, or any other metallic substance, interposed between laminations. The Ferguson playing card is only slightly weighted so as not to increase materially in thickness, or to affect the flexibility thereof. Edwards, U.S. Pat. No. 2,600,951, provides card game equipment, including para-magnetic playing cards and a magnetic playing surface for use in conjunction with the cards. The magnetic playing surface comprises areas exhibiting magnetic characteristics, while the playing card bodies include sheets of para-magnetic foil arranged as laminations covered with protective coatings. A multi-game deck of tiles is disclosed by Lee, U.S. Pat. No. 4,147,363, which comprises 168 tiles bearing indicia of months and seasons for playing Metropolee. The tiles are typically made of plexiglass, plastic, wood or ivory for playing Metropolee, a/k/a Four Seasons, as detailed in the specification. Finally, traditional type playing cards are disclosed in U.S. Pat. No. 433,656, issued to Sommer, and U.S. Pat. No. 5,226,665, issued to Huang. Huang teaches an anti-stick playing card made from a sheet of polyvinyl chloride coated with a paint and embossed with stripes and raised portions, while Sommer teaches 104 individual cards divided into 4 suits bearing markings such as hearts, diamonds, clubs, spades, the English alphabet and numbers which represent the frequency with which letters born by that card occur in words in the English language. In contrast with the present invention, the cited art does not provide game pieces which may be used for playing conventional card games and traditional games in combination by all individuals indoors and outdoors under varying weather conditions.

Therefore, a novel card game set having increased weight and structural dimensions for improved handling, outdoor use and greater durability would be well received. The present invention addresses the problems noted with traditional playing cards. The instant invention provides waterproof, windproof and easier handling cards for playing indoors and outdoors, and offers a game set that allows for creating new games. Applicant's invention also teaches novel playing tiles having a support deck in combination therewith. The novel card game set is designed so that it can be played outside by individuals of all skill and ages, including arthritic individuals, and under varying weather conditions including wind and inclement weather.

SUMMARY OF THE INVENTION

In accordance with the foregoing, it is an object of the present invention to provide a novel card game set which includes block-style tiles having sufficient weight and thickness for playing outdoors and while traveling, and which includes a rack for supporting the block tiles in a manner that organizes the tiles while keeping them concealed from the view of other players.

It is another object of the instant invention to provide a novel card game set having block-style tiles bearing playing card indicia and that are durable for withstanding rugged use and which has potentially infinite durational use.

It is a further object of the instant invention to provide novel game tiles bearing playing card indicia for playing traditional Western-style card games, conventional games such as cards, dominos, and scrabble, in combination or individually, and other novel games.

It is an additional object of the instant invention to provide novel game tiles having a protective coating shell that protects indicia appearing on the face of the tile from marring and that provides a semi-rough and semi-smooth surface for easy handling in building card tile structure and in simply playing regular games.

It is yet another object of the instant invention to provide novel card game tiles of a rectangular block design for easy handling by the arthritic, young, or unskilled players.

It is still another object of the instant invention to provide a novel card game set with novel block-style tiles bearing traditional card game indicia for conveniently playing card games and novel games while traveling or outdoors.

It is yet another object of the instant invention to provide a novel card game set including novel card game tiles that are windproof, waterproof, and essentially damage-proof.

With reference to the foregoing objects and other objects which may become apparent, the instant invention is a novel card game set comprising novel block-style tiles bearing traditional Western-style card game indicia and a rack for organizing a select number of tiles. The rack allows the tiles to be placed in a strategic alignment for playing conventional or contemporary games. The novel tiles are designed so that they may be employed in playing a combination of games, including a new form of scrabble, dominos, and regular cards, either individually or in combination. In other words, the tiles may be used for placement horizontally and vertically in a central location relative to the players whereby tiles are discarded by the players to form predetermined sequences such that the face indicia corresponds in some related fashion, such as by color, suit, or sequential sequence. The tiles may also be used for building card tile structures, including walls and floors. On the other hand, the tiles may also be used to form a solid, block-like structure that could subsequently be manipulated by removing individual tiles one at a time until the block is caused to collapse. In any of the games decided for play, points may be accumulated by calculating the weighted values as indicated by the indicia on the tiles.

The tiles are designed to have sufficient weight, shape, and thickness to be wind-resistant and easy to handle. In addition, the tiles contain a protective shell that makes the tiles waterproof and damage-proof. While the tiles may be fabricated by either plastic or wood, a layered plywood-type design is preferred. That is, the tiles are made aesthetically pleasing and structurally sound by manufacturing them from layered wood pieces pressed together in a permanent manner. In addition, the coating shell on the tiles provides a semi-rough surface so that they may be easily handled and gripped by all types of players. Moreover, the coating provides a semi-smooth surface so that when building a block structure, the tiles may be removed from the block easily by slidably disengaging them from the block. The tiles also have a semi-rough surface which allows them to be easily gripped for removal from a block of tiles such as that described above, or for general easy handling.

The tiles and rack of the instant invention are meant to be durable and child-safe for rugged use and versatile applications. The flat, continuous surface and finished edges of the tiles make them childproof, while the indicia and block-like structure allow many conventional and contemporary games to be played in unique variations.

In accordance with these and other objects which will become apparent hereinafter, the instant invention will now be described with particular reference to the accompanying drawings.

DESCRIPTION OF THE PREFERRED EMBODIMENTS

Figure 1:
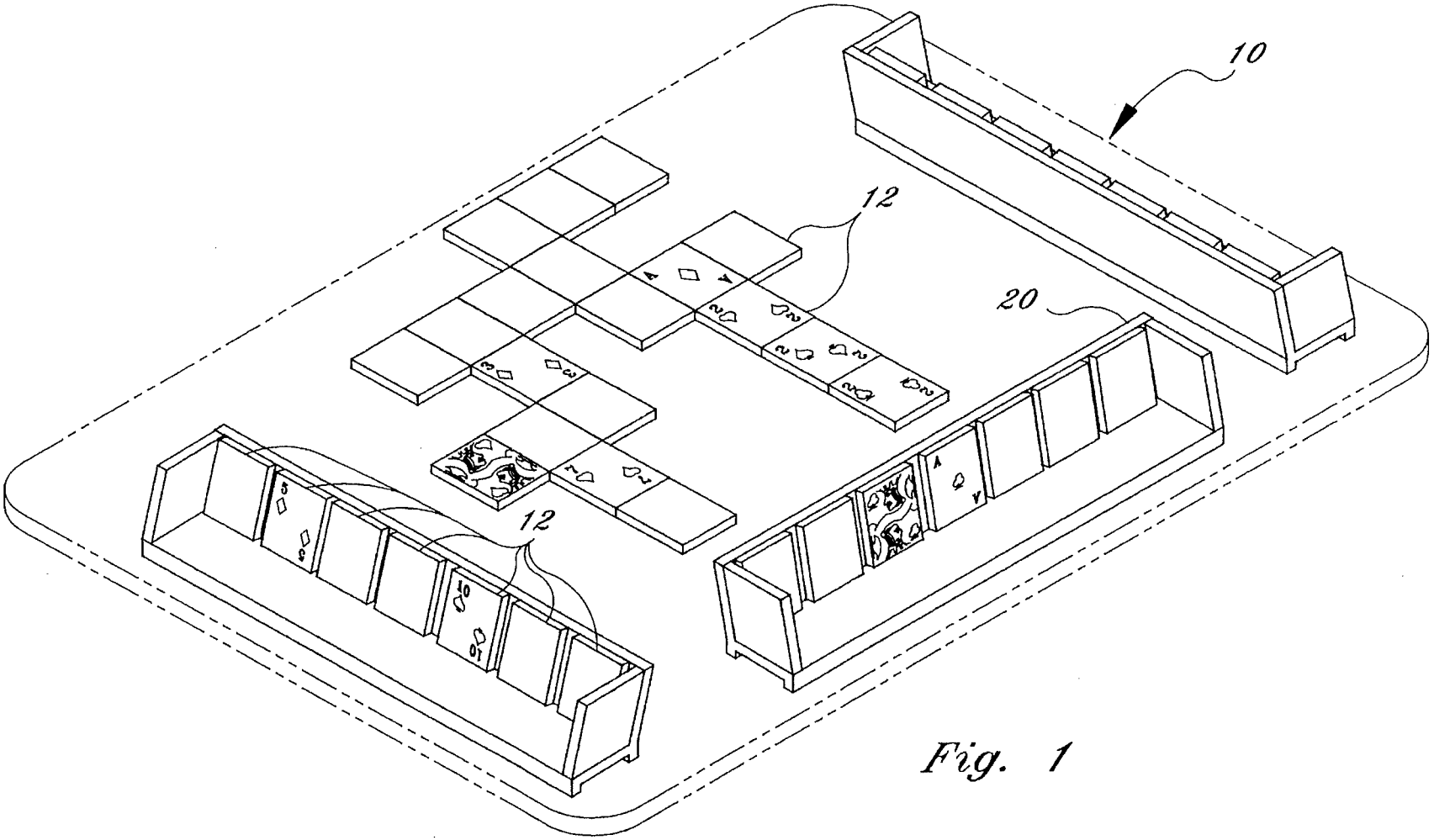
FIG. 1 is a perspective view of the preferred embodiment of the novel game set illustrating the playing tiles and racks on a platform as employed in a game similar to scrabble.
Figure 1A:
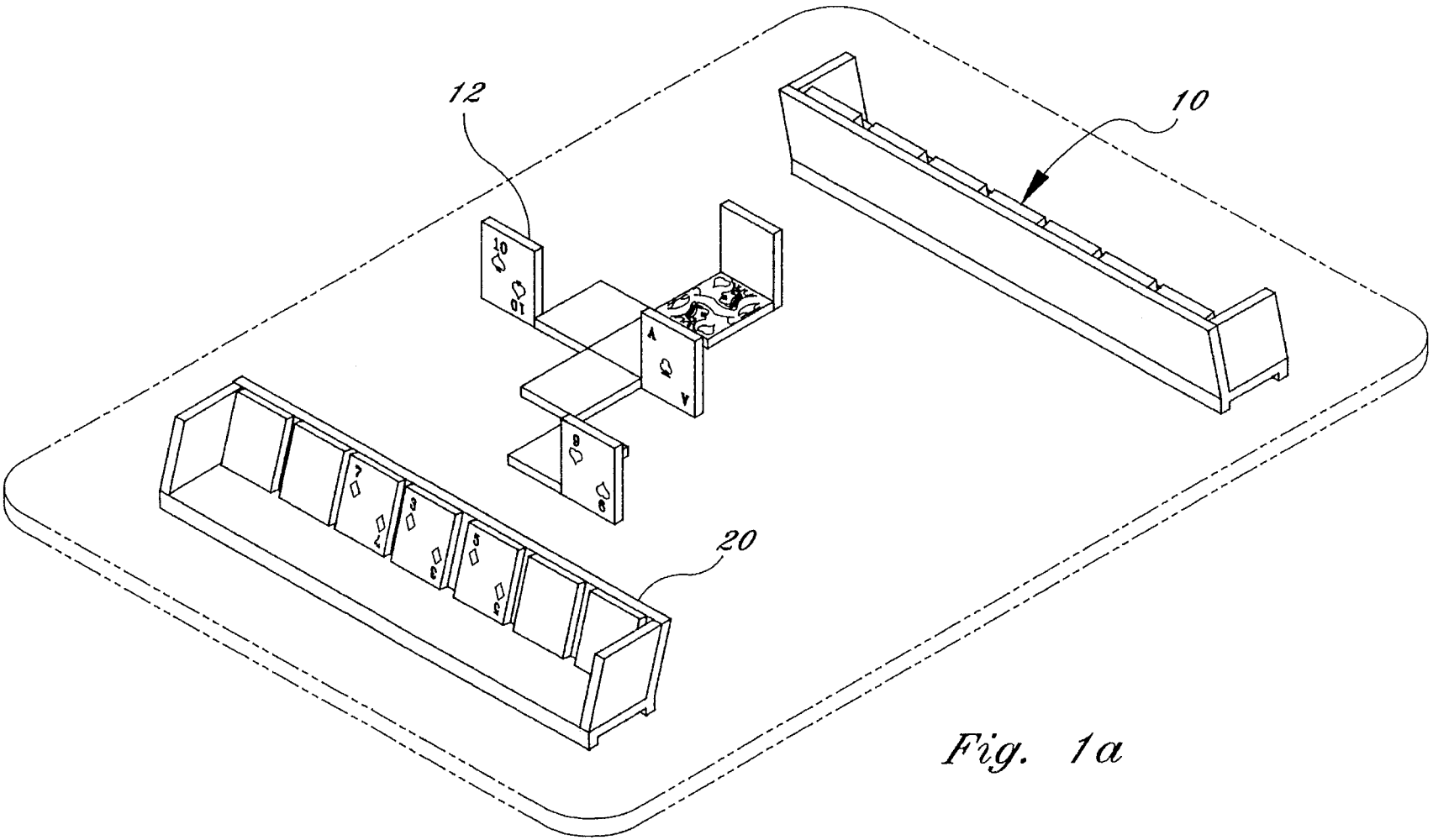
FIG. 1*a* is a perspective view of the preferred embodiment of the novel game set illustrating the playing tiles and racks on a platform as employed in a novel game with selected tiles positioned either vertically or horizontally.
Figure 2:
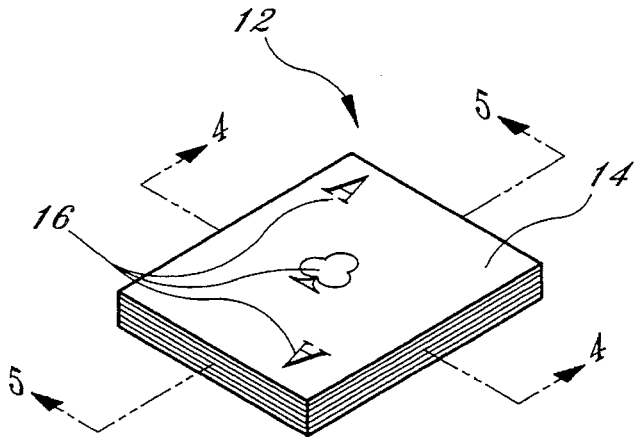
FIG. 2 is a perspective view of the preferred embodiment of an individual tile.
Figure 3:
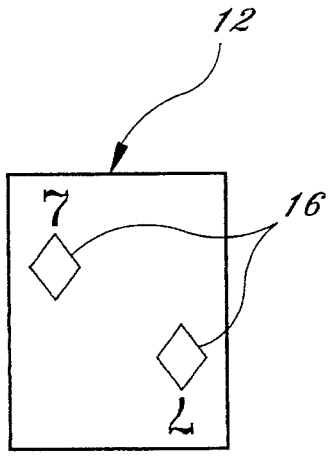
FIG. 3 is a front elevational view of an individual tile.
Figure 4:
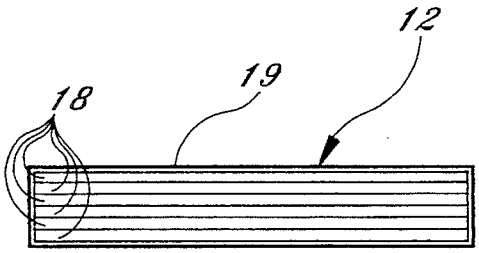
FIG. 4 is a cross-section view of an individual tile taken along lines 4—4 of FIG. 2, illustrating the wood layered construction.
Figure 5:
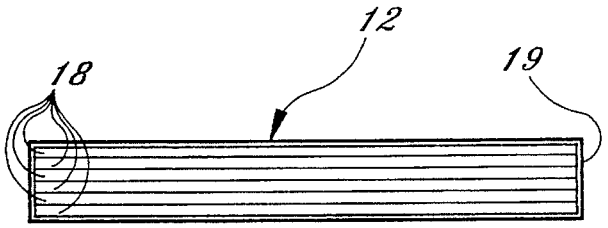
FIG. 5 is a cross-section view of an individual tile taken along lines 5—5 of FIG. 2, illustrating the wood layered construction.

With reference to the drawings, FIGS. 1–7 depict a novel game tile set characterized by the numeral 10. In FIGS. 1 and 1*a* the tiles 12 are seen employed in games such as scrabble or a novel game with tiles being selectively oriented horizontally and vertically. The tiles 12 may be played on any flat platform as seen in the drawings such as card tables, airplane tables, card board platforms, just to name a few. The present invention 10 comprises a plurality of two dimensional game playing pieces or tiles 12 bearing playing card indicia 16 on the surface 14 and having sufficient weight and structural durability for playing traditional and new games outdoors or while traveling in a car, plane, bus or train. The preferred embodiment of the instant invention 10, as seen in FIG. 1, further includes a plurality of racks 20 for holding a select number of game tiles 12 to leave the hands free, to conceal the playing cards' faces 14, and to organize and arrange the tiles 12 in strategic alignment for planning moves as dictated by the game being played. The game pieces 12 as designed are intended to facilitate playing on the beach, by a pool, in windy conditions, wet conditions or just generally outdoors. That is, the instant game tiles 12 are designed to be windproof and waterproof.

The, the present invention comprises a set of card styled tiles 12, which comprise rigid substantially rectangular playing members having sufficient weight and durability for playing outdoors and while traveling, and sufficient thickness to allow easy handling by young, unskilled, and arthritic players. The tiles 12 define flat, continuous surfaces that afford the building of card tile structures by vertically and horizontally orienting the tiles 12 in cooperative relationship to form walls and floors, or to just form solid block structures. The tiles 12 also define surfaces which are both semi-smooth and semi-rough for allowing the tiles 12 to be pulled from a solid block structure as described above while also allowing the tiles to be easily gripped. The tiles 16 are not easily destroyed, damaged or defaced like the conventional playing cards because of a high grade plywood material used to fabricate the tiles and a high grade coating 19 applied to the tiles 12 to protectively insulate the surfaces of the game pieces. The game tile pieces 12 include visual indicia means 16 which typically and preferably comprise the indicia used on card playing faces, so that essentially fifty-two (52) tiles end up comprising the novel set of card tiles 12. The shape, weight and material used for the game tile pieces 12 allow them to be handled without wrecking or marring the tile surfaces or face 14. Finally, the rack 20 is designed to prevent the viewing of the tile faces 14 by other players. The rack has a back member 22 that tilts back at a convenient angle and side panels 24 that prevent unwanted viewing from the side.

The instant invention provides tiles 12 that may be used to play games outdoors, indoors or while traveling. This is accomplished by providing tiles with sufficient weight and textured tile surfaces. The tiles 12 have a shape, weight and texture that facilitate easier handling in places that use to be considered adverse for playing traditional card games. While the tiles 12 are heavy enough to sufficiently resist being blown away by wind, drafts or sudden gusts, they are also light enough and thick enough for easy handling. Referring to FIGS. 2–5, the tiles are also shorter and significantly more rigid than conventional cards, much like a rectangular block, so that wind is not able to get under and lift the tiles 12. Each tile 12 is preferably 0.09 to 0.4 ounces, approximately 0.2 to 0.3 inches thick and approximately 1.25 by 1.0 inches (1.25"×1.0"). The game tiles 12 are preferably manufactured into a high grade plywood comprising wood layers 18, which may or may not be prelaminated. The plurality of layers 18 are pressed and permanently held together to form a high grade plywood tile 12. The plurality of layers are permanently adhered together by an epoxy or by machine pressing or a combination of the two processes to form a durable plywood-like playing piece 12. The tiles 12 are protected from water and structural damage by a coating 19 adhered to the surfaces of the tiles 12 thereby providing essentially a hard shell insulation 19. The protective shell 19 generally comprises an enamel type coating which seals all crevices, cracks and voids making the tiles substantially waterproof and damage resistant. In addition the coating shell 19 is designed to provide a rough and textured surface for easier gripping and protective insulation to prevent marring to the surface face indicia 16, the corners and other surfaces. Once a tile 12 is dipped into a coating mixture it leaves a coating shell 19 having a rough, unfinished surface. The shell coated surface 19 may be made semi-rough by leaving it in an unfinished state, by cutting indiscriminate grooves into the shell 19 or by mixing a granular substance, such as sand, into the coating mix before dipping the tiles 12 therein. In addition, the wood layers 18 may be left unfinished, that is, not sanded after joining the layers 18 to further effectuate a rougher exterior surface after forming the shell. In the alternative, the coating may include the addition of an adhesive or epoxy mixture into the coating or the application of the same over the shell 19 after the dipping and curing process. The end result with any of the methods is a coating shell 19 which provides greater friction inducing surfaces. Together, the textured or coated surface and the high grade plywood manufactured design add to the durability and longevity of the game tile pieces.

Figure 7:
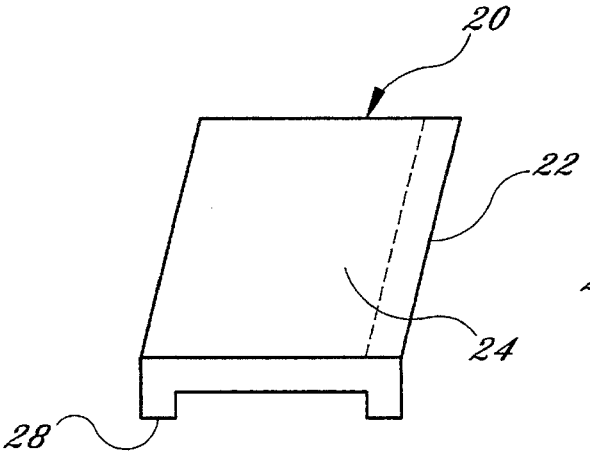
FIG. 7 is an end elevational view of the preferred embodiment of the rack illustrating the angled profile.
Figure 6:
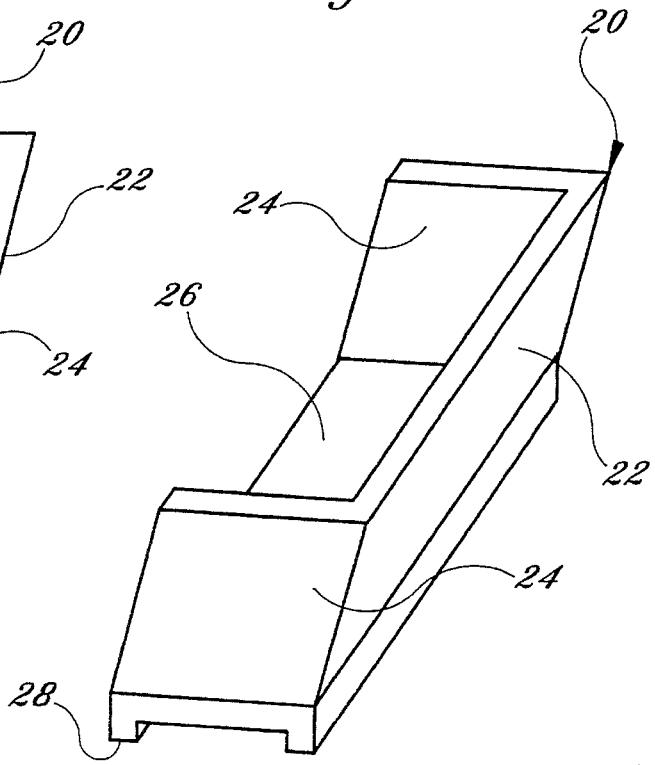
FIG. 6 is a perspective view of the preferred embodiment of the rack.

With reference to FIGS. 6 and 7, the rack 20 comprises either a wood or plastic frame having an elongated back member 22, side panels 24 extending forward from the back member 22 and a bottom panel or member 26 extending forward from the back member 22 below the side panels 24. The bottom panel 26 preferably abuts the side panels' lower ends and extends an equal distance from the back member 22. Elongated leg members 28 may also be employed for supporting the rack 20 in an elevated position. The leg members 28 would depend from the lower surface of the bottom panel 26. The back member 22 is preferably angled back to provide a slight tilt for making it easier for the player to comfortably view the pieces. That is, the back member 22 would be angled so that the average person's line of sight would comfortably align with back member to which the tiles 12 rest against. When viewing the rack 20 from either side, as seen in FIG. 7, the rack 20 and side panels 24 resemble a parallelogram. Thus, the side panels 24 conceal the tile pieces 12 from other players but they remain easily viewable by the corresponding player. Finally, the back member 22 and side panels 24 have a height that is relatively close to that of the tiles to sufficiently conceal the tile indicia 16.

The tile game pieces 12, in the alternative, may be made of plastic which could also be formed by layers pressed and adhered together with adhesives, such as epoxy, or by high tensiled stressed machining. In any event, there are preferably 52 tiles wherein each individual tile 12 represents a card in a regular deck of playing cards. Thus, each face includes indicia of a corresponding card from a deck. The novel card set 10 may also include two jokers. The surface of the tiles 12 when made from plastic would also include a rough finish for easier gripping when playing during travel in a car. The surfaces of the tiles could contain indiscriminate grooves, or remain unsanded for a rougher, easier gripping finish. The tile surfaces may also be made more coarse by a sandy or granular coating that facilitates gripping or the surface could include a lamination coating which has a sufficiently sticky or adhesive-like surface.

The present invention allows the combination and simultaneous play of conventional games, such as, scrabble, dominoes, and cards, all combined into one. The pieces may be utilized for playing new games in a two dimensional field where the pieces are arranged either horizontally or vertically such that the faces are seen only by a corresponding player and not the other players when the pieces are vertically oriented. For instance, one novel game would include distributing a predetermined number of tiles 12 for concealed placement in the rack 20 and then selectively placing the rigid tiles 12 in either horizontal or vertical positions depending on whether a complete combination is achieved by the tile or tiles discarded, as shown in FIG. 1. Points would be accumulated based upon the weight given the tiles 12 as determined by the card face indicia 16, the adjacent positioning of correlating tiles 12, the method of accumulating or discarding tiles 12, as well as the drawing or tiles into and discarding of tiles from the opponent's hand.

More specifically the game would include a first or master tile being positioned in a central playing field location relative to the players and then having the first player discard at least one tile piece 12 from their rack 20 when the face indicia 16 corresponds to the master tile indicia in a predetermined correlating relationship. That is, the master tile indicia and discarded tiles' indicia could correspond by color, sequential order, weight, poker hands or other groupings. The discarded tile or tiles 12 would be left vertical until a certain number of tiles forming a sequence is established at which time they would be horizontally oriented in a supine position. The players could be required to draw new tiles 12 if having nothing to discard or to replace discarded tiles depending on the rules the players want to follow. Of course, the players would rotate turns. The game could also be played like scrabble whereby all pieces are discarded into horizontal supine positions but not until a complete required grouping is achieved and of course the groupings could play off of tiles 12 already positioned. The groupings in either game could be horizontal, vertical or diagonal in alignment. Accordingly the tiles 12 may be placed down to match corresponding tiles in a predetermined sequence such as a sequence used while playing card games such as poker, rummy or solitaire, or in a way described in any of the foregoing games. In all the games the rack 20 facilitates support and concealment of the game pieces and allows the player to arrange and establish a strategy to achieve victory. Points could be computed as pieces are discarded or by adding the weight of the pieces the players have left once a winning player is the first to discard all their tiles 12.

Another game which may be played by these novel game tiles 12 comprises constructing a card tile structure with the tiles 12 one piece at a time. That is, a first tile piece 12 would be vertically oriented by a first player and then other tiles 12 would be aligned with the first and subsequent tiles in cooperative relationship to build a structure having walls and sequential floors. Points based on the weights of the tiles could be added together by individual players or teams of players as tiles 12 are successfully added to the structure and points deducted for unsuccessful attempts to add tiles. In another game the tiles could be initially bunched together in a single uniform block structure and then individually pulled from the block structure one tile 12 at a time to create card playing hands. However, the trick would be to pull out a tile 12 from the block without collapsing it while trying to create a game winning sequence of tiles as determined by the indicia. Tiles 12, likewise, could be placed back into the block or used to build a new structure as aforementioned.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A novel game set, said set comprising:

(a) a plurality of rigid game pieces for playing a combination of games, each of said plurality of rigid game pieces each comprising a plurality of individually laminated wood layers permanently pressed together to form a high grade plywood piece, having a predetermined thickness sufficient for convenient handling by young, unskilled and arthritic persons, each said plywood piece being of sufficient weight to resist the force of wind and sudden drafts for facilitating the playing of games outdoors, each of said plurality of game pieces bearing an individual traditional playing card indicia to facilitate the playing of traditional western and novel card games;

(b) a waterproof enamel coating completely insulating each of said plurality of rigid game pieces to protect said game pieces from moisture and marring and to protect said game pieces from the defacing of the playing card indicia;

(c) a gripping means, defined by said waterproof coating, for producing a semi-rough surface for easy handling of each of said plurality of game pieces; and (d) each of said plurality of rigid game pieces being rectangular in shape and having flat side edges and ends for balancing said game pieces vertically and planar continuous surfaces for constructing traditional playing card houses and block structures and for enabling uninhibited slidable removal of said game pieces from said structure.

2. A novel game set as recited in claim 1, wherein said gripping means comprises a granular substance defined by said waterproof enamel coating to give each of said plurality of game pieces semi-rough exterior surfaces.

3. A novel game set as recited in claim 1, further comprising an elongated standing wooden rack for supporting a select number of said plurality of rigid game pieces when playing a combination of games, said rack comprising:

(a) a back member of sufficient height to conceal said game pieces;

(b) side panels extending from opposite ends of said back member for preventing viewing of said game pieces from either side of said rack; and (c) a horizontal bottom seat member extending from said back member below said side panels and engaging said side panels for supporting said game pieces, said back member being slightly angled backward in relation to a players natural line of sight to facilitate easy viewing by the player when the select number of said plurality of rigid game pieces is resting against said back member.

4. A novel game set as recited in claim 3, wherein each of said side panels defines a parallelogram having one edge engaging said back member for concealing said game pieces.

5. A novel game set, said set comprising:

(a) a plurality of rigid game pieces bearing traditional playing card indicia for playing a combination of games, each of said plurality of rigid game pieces comprising a substantially rectangular block having a predetermined thickness sufficient for convenient handling by young, unskilled and arthritic persons, said block defining a top surface, a bottom surface and opposite end surfaces all of which are flat, planar, and continuous to facilitate the constructing of traditional playing card houses and block structures by orienting said plurality of rigid game pieces vertically and horizontally in cooperative relationships, said surfaces being semi-smooth to facilitate slidably removing select blocks from said block structure, each said plywood piece being of sufficient weight to resist the force of wind and sudden drafts for facilitating the playing of games outdoors, said plurality of game pieces comprising fifty two game pieces each bearing an individual traditional playing card indicia such that said plurality of rigid game pieces represents a deck of traditional playing cards to facilitate the playing of traditional western card games and card houses;

(b) a waterproof enamel coating insulating each of said plurality of rigid game pieces to protect said game pieces from moisture and marring and to protect said game pieces from the defacing of the playing card indicia;

(c) a gripping means defined by said waterproof coating for easy handling of each of said plurality of game pieces, said gripping means making said surfaces semi-rough to provide minimal friction to facilitate gripping; and (d) each of said plurality of rigid game pieces formed by a plurality of individually laminated wood layers permanently adhered together by an adhesive.

6. A novel game set as recited in claim 5, further comprising an elongated standing wooden rack for supporting a select number of said plurality of rigid game pieces when playing a combination of games, said rack comprising:

(a) a back member of sufficient height to conceal said game pieces;

(b) side panels extending from opposite ends of said back member for preventing viewing of said game pieces from either side of said rack; and (c) a horizontal bottom seat member extending from said back member below said side panels and engaging said side panels for supporting said game pieces, said back member being slightly angled backward in relation to a players natural line of sight to facilitate easy viewing by the player when the select number of said plurality of rigid game pieces is resting against said back member.

7. A novel game set as recited in claim 5, wherein said gripping means comprises a granular substance defined by said waterproof enamel coating to give each of said plurality of game pieces semi-rough exterior surfaces.

* * * * *